US008678870B2

(12) United States Patent
Johnson

(10) Patent No.: US 8,678,870 B2
(45) Date of Patent: Mar. 25, 2014

(54) RETRACTABLE SWIM FINS

(76) Inventor: Mark R. Johnson, Sandy, UT (US)

( * ) Notice: Subject to any disclaimer, the term of this patent is extended or adjusted under 35 U.S.C. 154(b) by 315 days.

(21) Appl. No.: 12/939,053

(22) Filed: Nov. 3, 2010

(65) Prior Publication Data

US 2011/0104968 A1 May 5, 2011

Related U.S. Application Data

(60) Provisional application No. 61/258,094, filed on Nov. 4, 2009.

(51) Int. Cl.
*A63B 31/12* (2006.01)

(52) U.S. Cl.
USPC ..... 441/60

(58) Field of Classification Search
USPC ..... D21/806; 441/60–64
See application file for complete search history.

(56) References Cited

U.S. PATENT DOCUMENTS

| | | | | |
|---|---|---|---|---|
| 805,525 | A * | 11/1905 | Bullock | 441/60 |
| 3,268,927 | A | 8/1966 | Markowitz | |
| 3,315,286 | A | 4/1967 | Brion | |
| 4,017,925 | A | 4/1977 | Shamlian | |
| 5,151,060 | A | 9/1992 | Lam | |
| 5,338,235 | A | 8/1994 | Lee | |
| 5,536,190 | A | 7/1996 | Althen | |
| 5,593,333 | A | 1/1997 | Johnson | |
| 5,722,867 | A | 3/1998 | Lagrow | |
| 5,868,593 | A | 2/1999 | Feng | |
| 6,146,224 | A | 11/2000 | McCarthy | |
| 6,155,898 | A | 12/2000 | Burns | |
| 6,183,327 | B1 | 2/2001 | Meyer | |
| 6,568,973 | B2 | 5/2003 | Testa | |
| 6,672,920 | B2 | 1/2004 | Wilson | |
| 6,843,693 | B2 | 1/2005 | McCarthy | |
| 6,884,134 | B2 | 4/2005 | McCarthy | |
| D561,862 | S | 2/2008 | Moyal | |

(Continued)

FOREIGN PATENT DOCUMENTS

| | | |
|---|---|---|
| EP | 699456 | 3/1996 |
| FR | 2565498 | 12/1985 |
| WO | 2006058849 | 6/2006 |

OTHER PUBLICATIONS

International Search Report and Written Opinion from PCT/US2010/055486, dated Jan. 6, 2011.

(Continued)

*Primary Examiner* — Edwin Swinehart
(74) *Attorney, Agent, or Firm* — Dax D. Anderson; Kirton McConkie

(57) ABSTRACT

Retractable swim fins that attach to the legs of a swimmer to aid movement through the water. In one example embodiment, a retractable swim fin includes an upper support frame, a lower support frame, and a sliding assembly connecting the upper support frame to the lower support frame. The upper support frame is configured to be attached to the front of a swimmer's lower leg. The lower support frame includes means for aquatic propulsion and is configured to extend, in a swimming position, to a position beneath the sole of the swimmer's foot. The lower support frame is also configured to retract, in a walking position, to a position above the sole of the swimmer's foot. The walking position enables the swimmer to walk barefoot on a surface without the lower support frame substantially contacting the surface. The sliding assembly is configured to allow the lower support frame to retract.

25 Claims, 11 Drawing Sheets

(56) References Cited

U.S. PATENT DOCUMENTS

| | | | |
|---|---|---|---|
| D561,863 | S | 2/2008 | Moyal |
| 7,462,085 | B2 | 12/2008 | Moyal |
| 7,470,164 | B2 | 12/2008 | Moyal |
| 2005/0153607 | A1 | 7/2005 | Burns et al. |
| 2007/0004295 | A1 | 1/2007 | Rocci |
| 2007/0167095 | A1 | 7/2007 | Moyal |

OTHER PUBLICATIONS

Force Fin, Source: http://www.forcefin.com/Merchant2/merchant.mvc?Screen=PROD&Product_Code=XCTD, Date Accessed: Sep. 23, 2009.

International Search Report and Written Opinion from PCT/US2009/058244, dated Dec. 14, 2009, 14 pages.

* cited by examiner

RETRACTABLE SWIM FINS

CROSS REFERENCE TO A RELATED APPLICATION

This application claims priority to and the benefit of U.S. Provisional Patent Application Ser. No. 61/258,094, entitled SLIDING OR RETRACTABLE SWIM FINS, which was filed on Nov. 4, 2009, and is hereby incorporated by reference in its entirety.

BACKGROUND

1. Field of Invention

The present invention generally relates to swim fins and, in particular, to retractable swim fins that attach to the legs of a swimmer to aid movement through the water.

2. Description of Related Art

Typical swim fins are worn on the foot of a swimmer to aid movement through the water while surface swimming or participating in swimming-related activities such as bodyboarding, bodysurfing, kneeboarding, riverboarding, snorkeling, and various types of underwater diving. For example, scuba divers use swim fins to move through water efficiently, as human feet provide relatively poor thrust, especially when the diver is carrying equipment that increases hydrodynamic drag.

Unfortunately, typical swim fins have several problems. For example, since typical swim fins attach only to the foot and heel of a swimmer, typical swim fins can cause severe ankle strain and calf muscle fatigue. This is due to the mass of water moved by the fin and the fact that the ankle joint rotates through a complex, non-planar, arc. Further, the ankle does not generally orient the foot optimally for forward thrust, thus reducing the efficiency of the hydrofoil properties of the fin. Further, typical swim fins increase the footprint of the swimmer and are constructed of heavy and bulky materials, thus making it difficult to walk, as is often necessary when entering or exiting water via a shoreline, a boat, or a dock.

Another major problem with typical swim fins is related to an integral foot pocket which at least partially encloses the foot of the swimmer. Unfortunately, foot pockets tend to inadvertently gather foreign objects such as sand or gravel which can chafe the foot of the swimmer making swimming and walking uncomfortable or even painful, and can further risk infection. Also, foot pockets tend to retain some water which can be uncomfortable because the foot of the swimmer does not dry even when the swimmer is out of the water. Further, it can be difficult or impossible to clear foreign objects or water from the foot pocket without completely removing the swim fin from the foot of the swimmer. Also, foot pockets tend to restrict the other types of footwear, such as sandals or water socks, that can simultaneously be worn. Finally, foot pockets deprive the swimmer of the joyful sensation of walking bare-footed across the warm sand of a sandy beach or the cool grass of a grassy lawn.

BRIEF SUMMARY OF INVENTION

A need therefore exists for a swim fin that eliminates the above-described disadvantages and problems.

In one example embodiment, a retractable swim fin includes an upper support frame, a lower support frame, and a sliding assembly connecting the upper support frame to the lower support frame. The upper support frame is configured to be generally positioned along and attached to the front of a swimmer's lower leg between the swimmer's knee and ankle.

The lower support frame includes means for aquatic propulsion and is configured to extend, in a swimming position, to a position beneath the sole of the swimmer's foot. The lower support frame is also configured to retract, in a walking position, to a position above the sole of the swimmer's foot. The walking position enables the swimmer to walk barefoot on a surface without the lower support frame substantially contacting the surface. The sliding assembly is configured to allow the lower support frame to retract by sliding upward from the swimming position to the walking position.

In another example embodiment, a retractable swim fin includes an upper support frame, a lower support frame, and a sliding assembly connecting the upper support frame to the lower support frame. The upper support frame is configured to be generally positioned along and attached to the front of a swimmer's lower leg between the swimmer's knee and ankle. The lower support frame includes a lower blade and is configured to extend, in a swimming position, to a position beneath the sole of the swimmer's foot. The lower support frame is also configured to retract, in a walking position, to a position above the sole of the swimmer's foot. The walking position enables the swimmer to walk barefoot on a surface without the lower support frame substantially contacting the surface. The sliding assembly is configured to allow the lower support frame to retract by sliding upward from the swimming position to the walking position.

In yet another example embodiment, a retractable swim fin includes an upper support frame, a lower support frame, and a sliding assembly connecting the upper support frame to the lower support frame. The upper support frame is configured to be generally positioned along and attached to the front of a swimmer's lower leg between the swimmer's knee and ankle. The lower support frame includes a plurality of louvers and is configured to extend, in a swimming position, to a position beneath the sole of the swimmer's foot. The lower support frame is also configured to retract, in a walking position, to a position above the sole of the swimmer's foot. The walking position enables the swimmer to walk barefoot on a surface without the lower support frame substantially contacting the surface. The sliding assembly is configured to allow the lower support frame to retract by sliding upward from the swimming position to the walking position.

These and other aspects, features and advantages of the invention will become more fully apparent from the following detailed description of preferred embodiments and appended claims.

BRIEF DESCRIPTION OF DRAWINGS

The appended drawings contain figures of preferred embodiments to further clarify the above and other aspects, advantages and features of the invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF PREFERRED EMBODIMENTS

Figure 1:
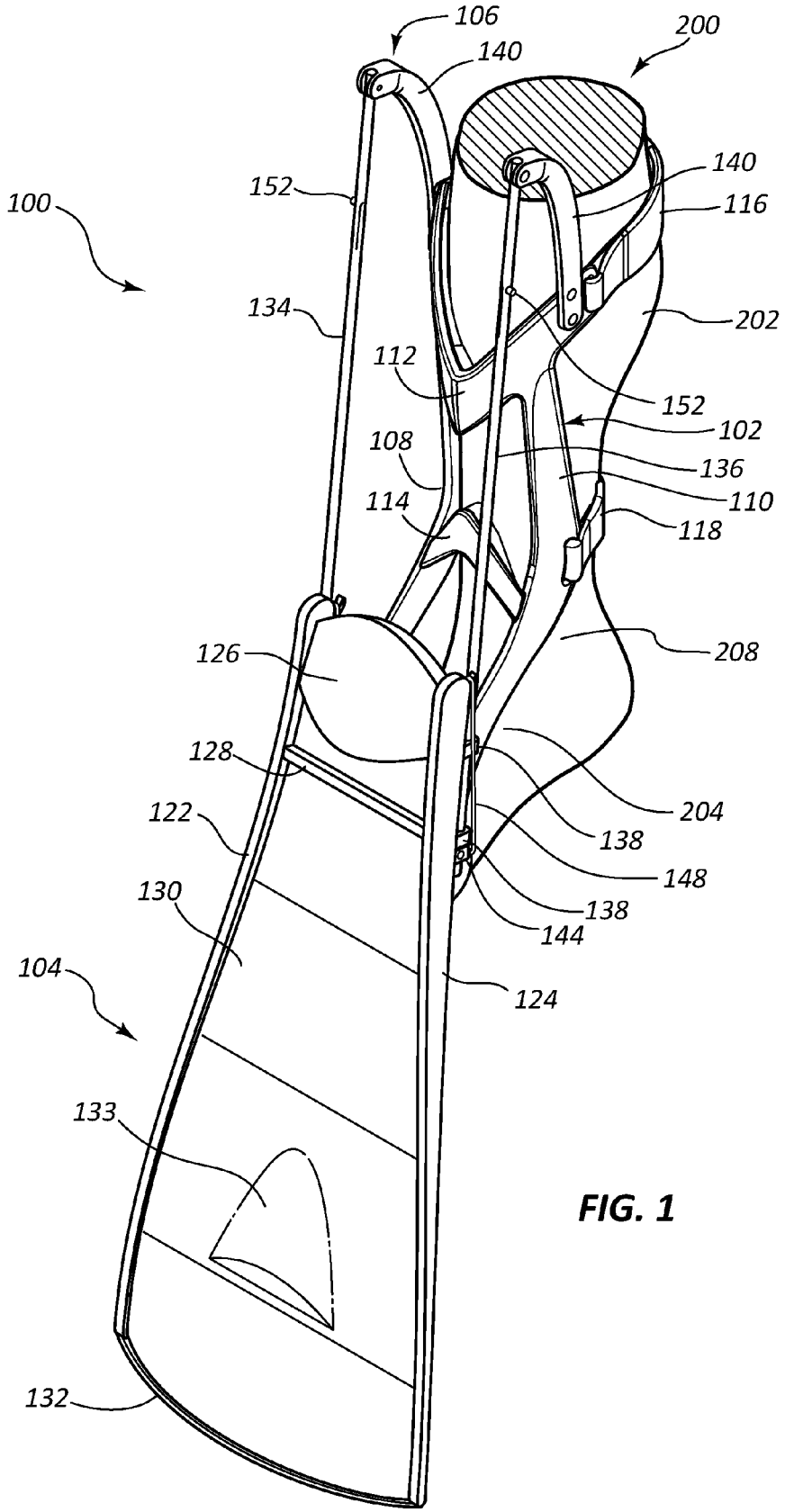
FIG. 1 is a perspective view of an example swim fin in a swimming position strapped to the leg of a swimmer.

It will be readily understood that the components of the present invention, as generally described and illustrated in the Figures herein, could be arranged and designed in a wide variety of different configurations. Thus, the following more detailed description of preferred embodiments is not intended to limit the scope of the invention, as claimed, but it is merely representative of some of the presently preferred embodiments of the present invention.

The present invention is generally directed towards retractable swim fins that are worn on the foot of a swimmer to aid movement through the water while surface swimming or participating in swimming-related activities such as bodyboarding, bodysurfing, kneeboarding, riverboarding, snorkeling, and various types of underwater diving. The swim fins disclosed herein are also specifically designed to be worn by the swimmer while the swimmer is walking in shallow water or out of the water such as on a beach, a boat, or a dock, for example, without interfering with the stride of the swimmer.

Additionally, to assist in the description of the swim fins, words such as top, bottom, front, rear, right, left, up, and down are used to describe the accompanying Figures, which are not necessarily drawn to scale. It will be appreciated, however, that the present invention can be located in a variety of desired positions, including various angles, sideways and even upside down. A detailed description of the swim fins now follows.

As discussed below and shown in the accompanying Figures, the swim fins may be worn by a swimmer in a "swimming position" while swimming as well in a "walking position" while walking along in or out of the water. This dual-functionality avoids the time and hassle of having to remove the swim fins in order to transition from swimming to walking. The dual-functionality also enables the swimmer to comfortably wear the swim fins well in advance of entering the water to swim, even when the swimmer must walk short or long distances before entering the water to swim. Further, the swim fins allow the swimmer to comfortably wear the swim fins even while wearing other footwear, such as sandals or water socks, for example. It is understood, however, that in some applications the swim fins can also be used without activating the retractable feature of the swim fins.

First Example Swim Fin

As disclosed in FIGS. 1-5, a first example swim fin 100 generally includes an upper support frame 102, a lower support frame 104, and a sliding assembly 106 connecting the upper support frame 102 to the lower support frame 104. The sliding assembly 106 is configured to allow the lower support frame 104 to retract by sliding upward from a "swimming position," disclosed in FIGS. 1 and 5, to a "walking position," disclosed in FIGS. 2 and 4, while the upper support frame 102 remains securely attached to the lower leg 202 of a swimmer 200.

Figure 4:
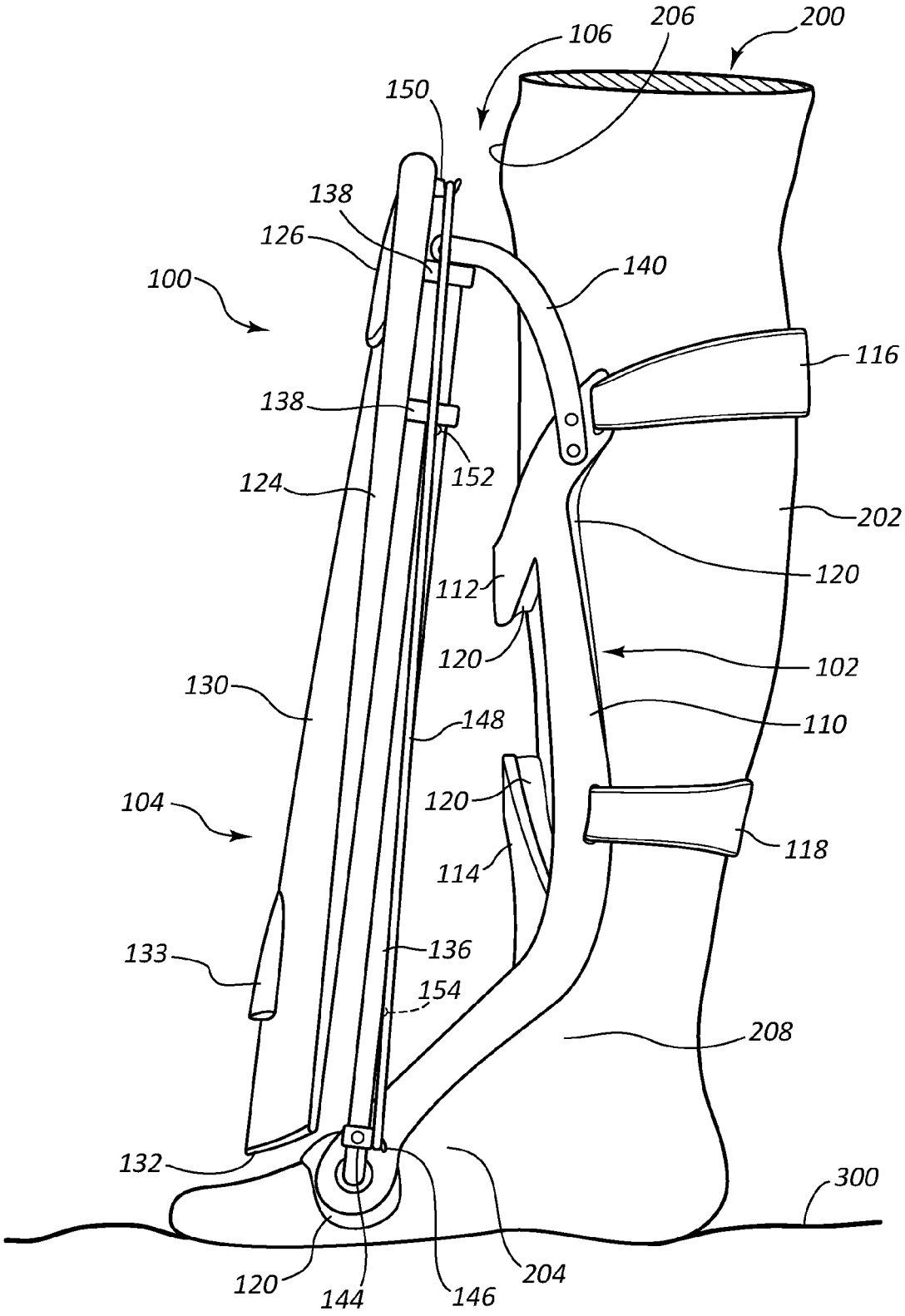
FIG. 4 is a side view of the example swim fin and leg of FIG. 1 in a walking position.
Figure 5:
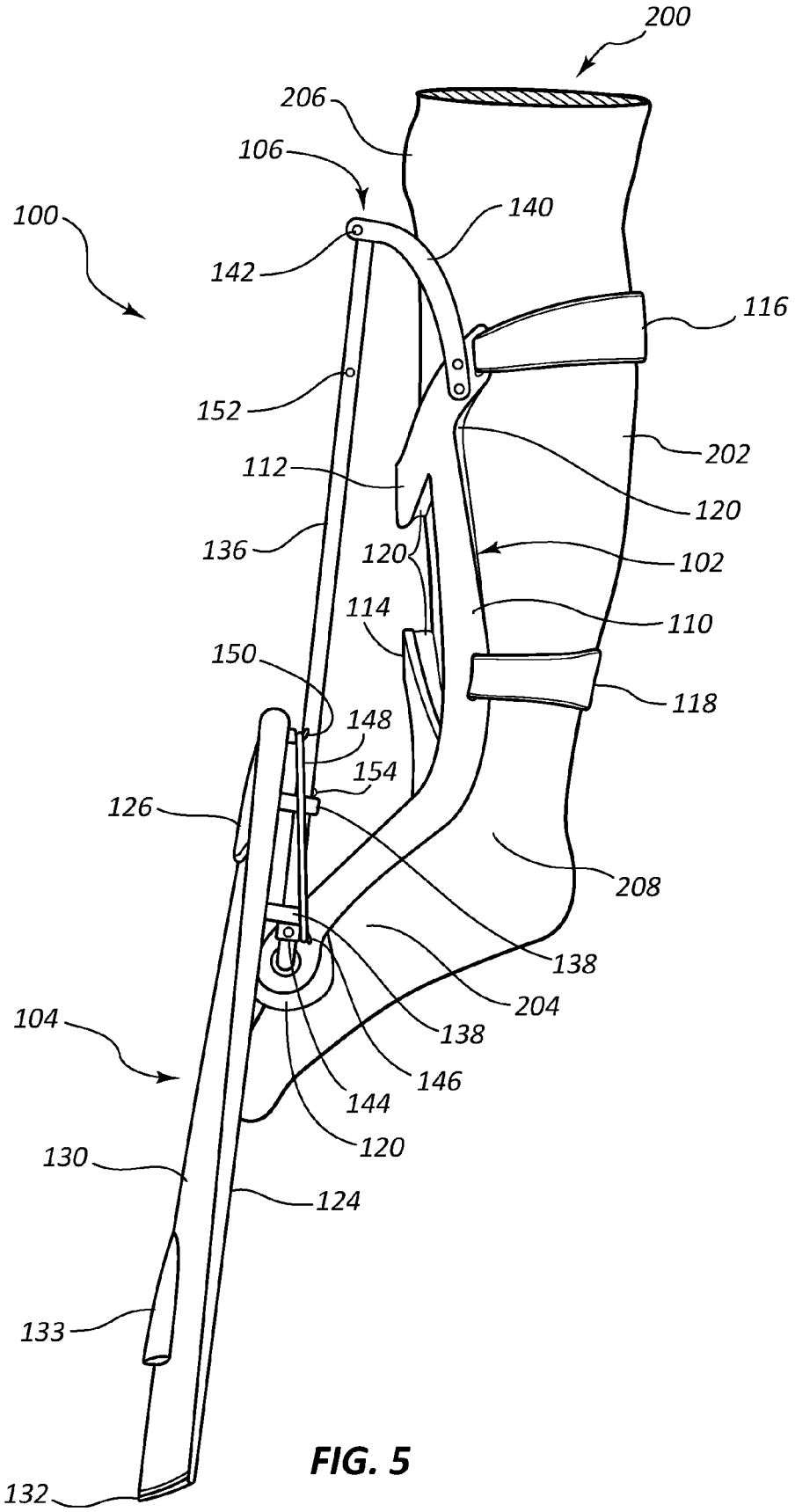
FIG. 5 is a side view of the example swim fin and leg of FIG. 1 in a swimming position.

As disclosed in FIGS. 1 and 5, in the swimming position, the lower support frame 104 is configured to extend to a position beneath the sole of the swimmer's foot 204. The swimming position disclosed in FIGS. 1 and 5 enables the swimmer 200 to swim through water with increased thrust as compared to swimming with a bare foot. As disclosed in FIGS. 2 and 4, in the walking position, the lower support frame 104 is configured to retract to a position above the sole of the swimmer's foot 204. The walking position disclosed in FIGS. 2 and 4 enables the swimmer 200 to walk barefoot on a surface 300 disclosed in FIG. 4 without the lower support frame 104 substantially contacting the surface 300 and without the swim fin 100 interfering with the stride of the swimmer 200.

As disclosed in FIGS. 4 and 5, the upper support frame 102 is configured to be generally positioned along the front of lower leg 202 of the swimmer 200 between the knee 206 and the ankle 208. The upper support frame 102 generally includes two braces 108 and 110 and two cross members 112 and 114. The braces 108 and 110 are configured to be positioned on either side of the swimmer's lower leg 202. The braces 108 and 110 are also configured to be attached to the sliding assembly 106. The cross members 112 and 114 connect and support the braces 108 and 110. The cross members 112 and 114 may further be configured to at least partially wrap around the front of the swimmer's lower leg 202.

The upper support frame 102 is configured to be securely attached to the swimmer's lower leg 202, instead of to the foot 204 or ankle 208. For example, the upper support frame 102 may further include a pair of straps 116 and 118 configured to attach the upper support frame 102 to the front of the swimmer's lower leg 202. The straps 116 and 118 may be adjustable straps to accommodate multiple swimmers with variously sized lower legs. For example, each of the straps 116 and 118 may include a buckle, Velcro®, a ratchet buckle, or other adjustable fastener to accommodate various sizes of lower legs. The straps 116 and 118 may be formed from various materials or combinations of materials including, but not limited to, polychloroprene.

The upper support frame 102 can be constructed, by molding for example, from a relatively rigid substance, such as a relatively rigid plastic, in order to provide structural support to the sliding assembly 106. It is understood, however, that portions of the upper support frame 102, such as middle portions of the two cross members 112 and 114, may be constructed from a less rigid substance in order to allow the upper support frame 102 to fit snuggly against the swimmer's lower leg 202 during swimming and walking.

As disclosed in FIGS. 4 and 5, the swim fin 100 may further include padding 120 positioned between portions of the upper support frame 102 and the front of the swimmer's lower leg 202 and foot 204. The padding 120 is configured to make direct contact with the swimmer's lower leg 202 and cushion the force of the braces 108 and 110 and the cross members 112 and 114 of the upper support frame 102 against the swimmer's lower leg 202 and foot 204 as the straps 116 and 118 are tightened and as the swimmer 200 walks and swims wearing the swim fin 100. The padding 120 can be formed, by stamping for example, from a soft and comfortable material, such as polychloroprene.

Figure 2:
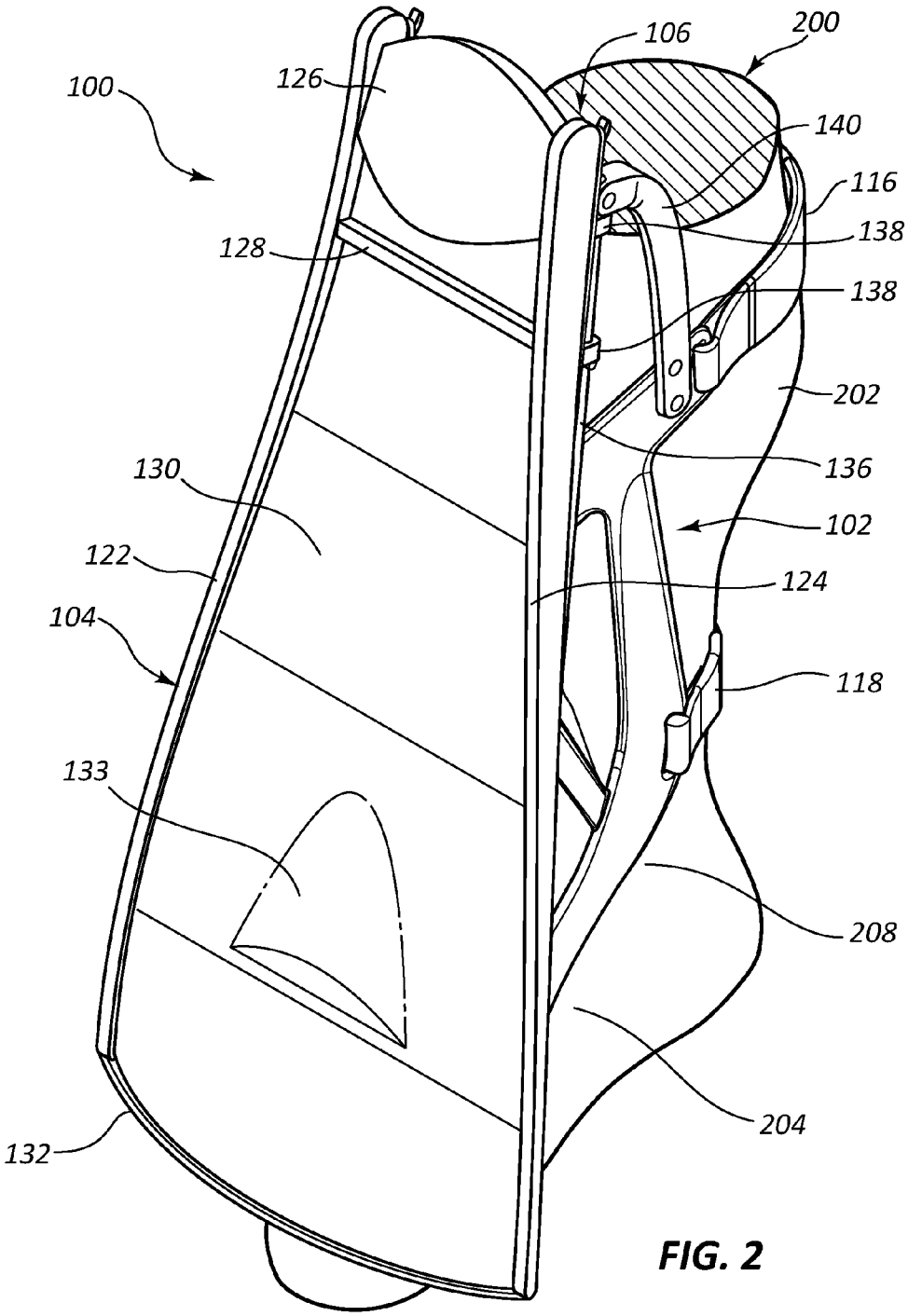
FIG. 2 is a perspective view of the example swim fin and leg of FIG. 1 in a walking position.
Figure 3:
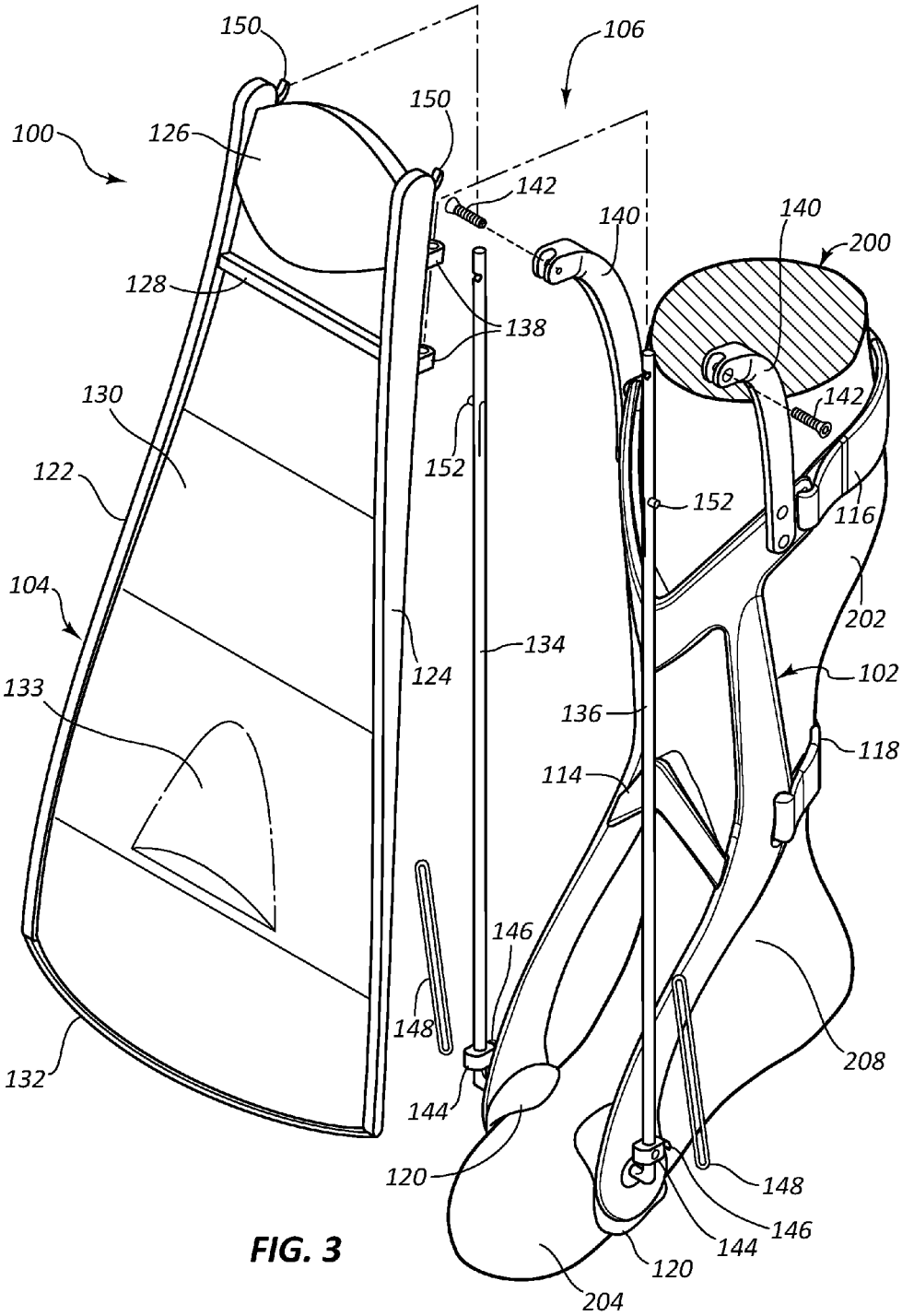
FIG. 3 is a perspective partially exploded view of the example swim fin and leg of FIG. 1.

As disclosed in FIGS. 1-3, the lower support frame 104 generally includes two braces 122 and 124, two cross members 126 and 128, and a lower blade 130. The lower support frame 104 may also include a blade protector 132 to protect the distal end of the lower blade 130 from damage. The braces 122 and 124 are configured to be positioned on either side of the swimmer's foot 204. The braces 122 and 124 are also configured to be attached to the sliding assembly 106. The cross members 126 and 128 connect and support the braces 122 and 124. The cross members 126 and 128 may further be configured to provide support to a portion of the lower blade 130. Advantageously, the cross member 126 and 128 and the lower blade 130 may enable the dorsum of the swimmer's foot 204 to contribute force to the downstroke of the swim fin 100 without any portion of the swim fin 100 being attached to the swimmer's foot 204.

The lower support frame 104 can be constructed, by molding for example, from a relatively rigid substance, such as a relatively rigid plastic, in order to provide structural support to the lower blade 130 and the sliding assembly 106. It is understood, however, that portions of the lower support frame 104, such as lower portions of the braces 122 and 124, may be constructed in such a way as to allow these portions to flex up (during a downstroke) and down (during an upstroke) while swimming. For example, the cross section of braces 122 and 124 could be generally rectangular, and the upper and lower sides of the braces 122 and 124 can be grooved to facilitate flexion in the upward and downward directions. Alternatively, or additionally, portions of the braces 122 and 124 can be constructed from a less rigid substance in order to allow these portions to flex up and down during swimming. In at least some example embodiments, the flexible portions of the braces 122 and 124 enable the lower support frame 104 to flex up and down, but avoid enabling the braces 122 and 124 to flex inward or side to side. For example, the cross members 126 and 128 can support the braces 122 and 124 in order to avoid the braces 122 and 124 from flexing inward toward one another or outward away from one another. Further, the function of the cross members 126 and 128 can be augmented by one or more additional cross members, or the cross member 128 can be removed as disclosed below in connection with FIGS. 8 and 9.

The lower blade 130 can be formed from a relatively light and flexible material, such as a relatively flexible vinyl, silicon, rubber, or rubberized rip-stop nylon material, in order to allow the lower blade 130 to flex during swimming. Furthermore, the lower blade 130 may be made from a partially or totally transparent material in order to avoid impeding the view of the swimmer's foot 204 during walking Further, the lower blade 130 may incorporate one or more hydrofoil chutes, such as the hydrofoil chute 133, that allow water to be pushed through the lower blade 130 in a direction that is generally inline with the forward motion of the swimmer 200. These hydrofoil chutes may be formed from a material that allows the chutes to transition from protruding from the top surface of the lower blade 130 (during a downstroke) to protruding from the bottom surface of the lower blade 130 (during an upstroke) in order to direct water propulsion and provide increased forward thrust during both the up and downstrokes while swimming.

As disclosed in FIG. 3, the sliding assembly 106 includes two substantially parallel rails 134 and 136 attached to the upper support frame 102, two slider clamps (not shown) attached to the brace 122 of the lower support frame 104, and two slider clamps 138 attached to the brace 124 of the lower support frame 104. As disclosed in FIGS. 1, 2, 4, and 5, each slider clamp 138 at least partially surrounds one of the rails 134 or 136 and is configured to allow the lower support frame 104 to retract by sliding upward along the rails 134 and 136 from the swimming position to the walking position and to extend by sliding downward along the rails 134 and 136 from the walking position to the swimming position.

It is noted that in this embodiment, the slider clamps 138 may either be formed as cylindrical slider clamps that each completely surrounds one of the rails 134 or 136, or the slider clamps 138 may be formed as C-shaped slider clamps that each only partially surrounds one of the rails 134 or 136. Where the slider clamps 138 are formed as C-shaped slider clamps, the slider clamps 138 of the lower support frame 104 may be clipped onto the rails 134 and 136 without detaching either end of each rail from the upper support frame 102. C-shaped slider clamps thus enable the lower support frame 104 to be quickly and easily swapped out with another lower support frame, such as any of the lower support frames disclosed in FIG. 8, 9, or 11, without the use of tools. It is further noted that instead of two slider clamps 138, each of the braces 122 and 124 of the lower support frame 104 may include only one slider clamp 138 or three or more slider clamps 138. Further, each slider clamp 138 may be formed to at least partially surround a greater or lesser length of the corresponding rail 134 or 136.

As disclosed in FIG. 3, the sliding assembly 106 may also include a pair of support arms 140, a pair of fasteners 142, a pair of lower stops 144 and corresponding hooks 146, a pair of elastic bands 148, a pair of hooks 150 attached to the lower support frame 104, and a pair of spring-loaded posts 152. The fasteners 142 are configured to attach the rails 134 and 136 to the support arms 140, respectively. The support arms 140 function to attach the rails 134 and 136, respectively, to the upper support frame 102. The support arms 140 also function to limit the upward travel of the lower support frame 104. The lower stops 138 function to limit the downward travel of the lower support frame 104.

As disclosed in FIGS. 3 and 5, the elastic bands 148 attach between the hooks 146 and 150. It is noted that the hooks 146 and 150 disclosed in the Figures could be replaced with hooks configured as slightly opened eyelets in order to more securely retain the elastic bands 148. The elastic bands 148 are configured to automatically slide the lower support frame 104 from the walking position to the swimming position. The elastic bands 148, in combination with a pair of friction bumps 154 (only one of which is shown in FIG. 5) or other higher-friction surfaces or structures on the rails 134 and 136, are also configured to maintain the lower support frame 104 in the swimming position. Although not shown in the Figures, the rails 134 and 136 may be curved toward the bottom to encourage the lower support frame 104 to remain in the swimming position or to fine tune the functional orientation of the lower support frame 104 once extended into the swimming position.

The elastic bands 148, in combination with a pair of friction bumps 154 (only one of which is shown in FIG. 5) or other higher-friction surfaces or structures on the rails 134 and 136, allow the lower support frame 104 to automatically slide upward if the swimmer 200 stands on the swim fin 100 in the swimming position without bending or otherwise damaging the lower support frame 104 and/or the sliding assembly 106 of the swim fin 100. The bias of the elastic bands 148, in combination with a pair of friction bumps 154 (only one of which is shown in FIG. 5), can also and more typically be overcome by the swimmer grasping the lower support frame 104 in the swimming position and manually pulling upward, thus sliding the lower support frame 104 to the walking position As disclosed in FIGS. 3 and 4, when the lower support frame 104 is manually slid into the walking position, the elastic bands 148 are stretched. Once the lower support frame 104 is fully retracted into the walking position, the spring-loaded posts 152 function to lock the lower support frame 104 in the walking position. The four slider clamps 138 (only two of which are shown in the Figures) may be configured with inner ramped surfaces so that the lower support frame 104 can manually slid into the walking position without manipulating the spring-loaded posts 152. However, in order to allow the elastic bands 148 to automatically extend lower support frame 104 into the swimming position, the spring-loaded posts 152 must be manually pressed into the rails 134 and 136 to allow the two lower slider clamps 138 (only one of which is shown in the Figures) to slide down past the spring-loaded posts 152. The two upper slider clamps 138 (only one of which is shown in the Figures) may be configured with two-way ramped surfaces to automatically slide up or down past the spring-loaded posts 152 without requiring manual manipulation of the spring-loaded posts 152.

The spring-loaded posts 152 are therefore one example structural implementation of a means for locking the lower support frame 104 in the walking position. It is noted that a variety of means may be employed to perform the functions disclosed herein concerning the spring-loaded posts 152 locking the lower support frame 104 in the walking position. Thus, the spring-loaded posts 152 comprises but one example structural implementation of a means for locking the lower support frame 104 in the walking position.

Accordingly, it should be understood that this structural implementation is disclosed herein solely by way of example and should not be construed as limiting the scope of the present invention in any way. Rather, any other structure or combination of structures effective in implementing the functionality disclosed herein may likewise be employed. For example, in some example embodiments of the example swim fin 100, the spring-loaded posts 152 may be replaced or augmented with one or more other locking mechanisms, latches, fasteners, or hooks. For example, a single latch may be employed to lock the lower support frame 104 to the upper support frame 102 with the lower support frame 104 in the walking position. In yet other example embodiments, the locking functionality may be accomplished by some combination of the above example embodiments. Also, although not shown in the Figures, the rails 134 and 136 may be curved toward the top to encourage the lower support frame 104 to remain in the walking position or to fine tune the functional orientation of the lower support frame 104 once retracted into the walking position to reduce the possibility of one lower support frame 104 from striking the other. A curve formed toward the top of the rails 134 and 136 may thus be another structural implementation of a means for locking the lower support frame 104 in the walking position.

The lower blade 130, including the hydrofoil chute 133, functions to propel the swimmer 200 through the water during downstrokes and upstrokes of the swimmer's lower leg 202. The lower blade 130 is therefore one example structural implementation of a means for aquatic propulsion. It is noted that a variety of means may be employed to perform the functions disclosed herein concerning the lower blade 130 propelling the swimmer through the water. Thus, the lower blade 130 comprises but one example structural implementation of a means for aquatic propulsion.

Accordingly, it should be understood that this structural implementation is disclosed herein solely by way of example and should not be construed as limiting the scope of the present invention in any way. Rather, any other structure or combination of structures effective in implementing the functionality disclosed herein may likewise be employed. For example, in some example embodiments of the example swim fin 100, the lower blade 130 may be replaced or augmented with one or more other blades, hydrofoil chutes, or louvers, such as any of the louver disclosed in FIGS. 8-11. In yet other example embodiments, the aquatic propulsion functionality may be accomplished by some combination of the above example embodiments.

First Alternative Swim Fin

Figure 6:
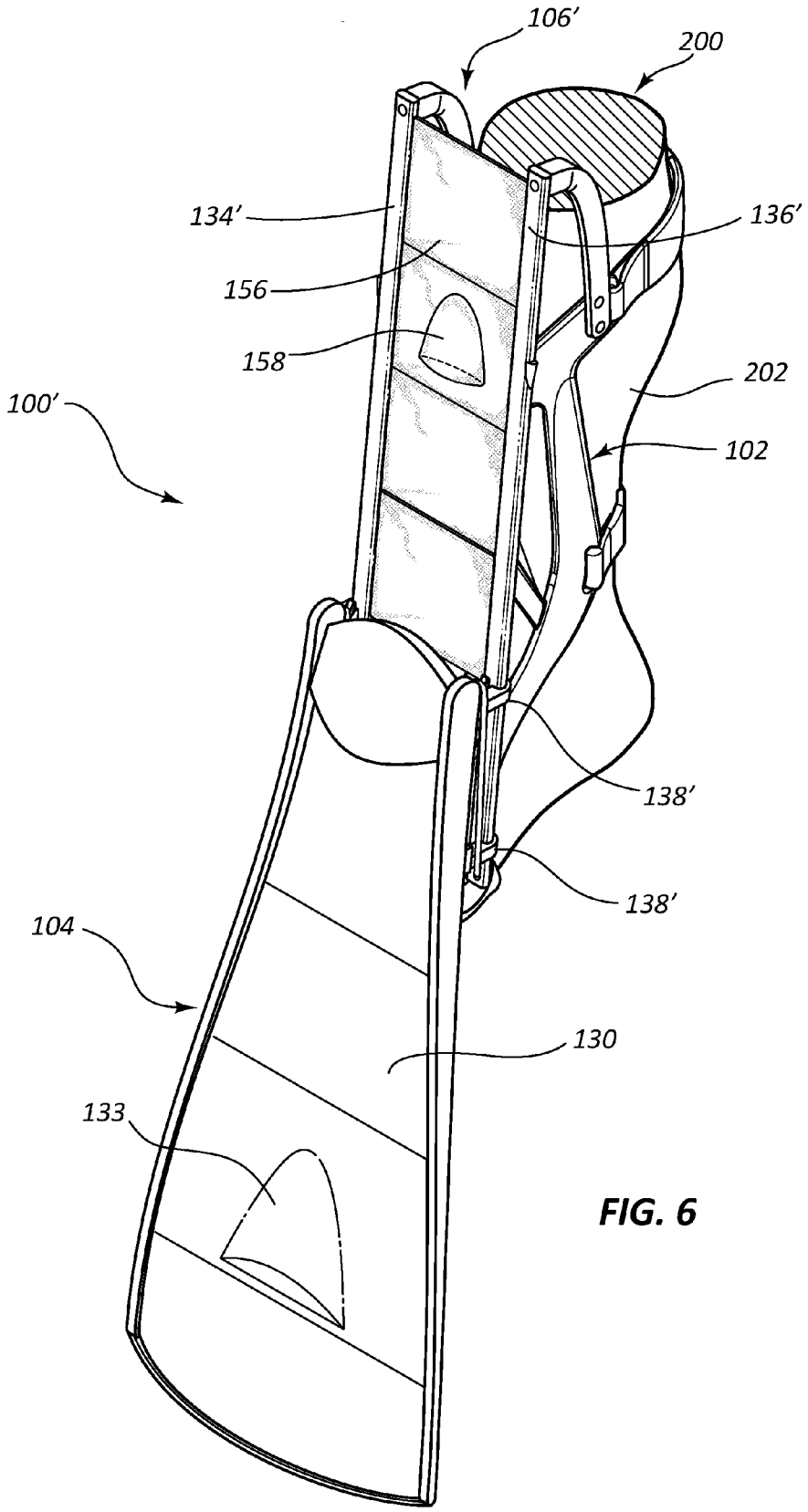
FIG. 6 is a perspective view of the a first alternative swim fin in a swimming position strapped to the leg of a swimmer.

With reference now to FIG. 6, aspects of a first alternative swim fin 100' are disclosed. The first alternative swim fin 100' is identical to the first example swim fin 100 disclosed in FIGS. 1-5, except that the first alternative swim fin 100' includes a first alternative sliding assembly 106' that includes an upper blade 156 positioned between the two alternative rails 134' and 136'. It is noted that the four alternative slider clamps 138' (only two of which are disclosed in FIG. 6) are configured as C-shaped slider clamps with the open portion of the C shape aligning with the position of the upper blade 156 so that the upper blade 156 does not impede the sliding of the slider clamp 138' up and down along the rails 134' and 136'.

The upper blade 156 can be formed from any of the material mentioned above in connection with the lower blade 130. Furthermore, the upper blade 156 may be made from a partially or totally transparent material in order to avoid impeding the view of the swimmer's foot 204 or lower leg 202 during walking Further, the upper blade 156 may incorporate one or more hydrofoil chutes, such as the hydrofoil chute 158, that allow water to be pushed through the upper blade 156 in a direction that is generally inline with the forward motion of the swimmer 200. These hydrofoil chutes may be formed similarly and function similarly to the hydrofoil chutes, such as the hydrofoil chute 133, discussed above in connection with the lower blade 130.

The upper blade 156, including the hydrofoil chute 158, functions to propel the swimmer 200 through the water during downstrokes and upstrokes of the swimmer's lower leg 202, in tandem with the lower blade 130. The upper blade 156 is therefore one example structural implementation of a means for aquatic propulsion. It is noted that a variety of means may be employed to perform the functions disclosed herein concerning the upper blade 156 propelling the swimmer through the water. Thus, the upper blade 156 comprises but one example structural implementation of a means for aquatic propulsion.

Accordingly, it should be understood that this structural implementation is disclosed herein solely by way of example and should not be construed as limiting the scope of the present invention in any way. Rather, any other structure or combination of structures effective in implementing the functionality disclosed herein may likewise be employed. For example, in some example embodiments of the example swim fin 100', the upper blade 156 may be replaced or augmented with one or more other blades, hydrofoil chutes, or louvers, such as any of the louvers disclosed in FIGS. 8-11. In yet other example embodiments, the aquatic propulsion functionality may be accomplished by some combination of the above example embodiments.

It is further noted that the first alternative swim fin 100' could be employed by the swimmer 200 with the lower support frame 104 completely removed, leaving only the upper blade 156, or other means for aquatic propulsion positioned between the two alternative rails 134' and 136', to propel the swimmer 200 through the water.

Second Alternative Swim Fin

Figure 7:
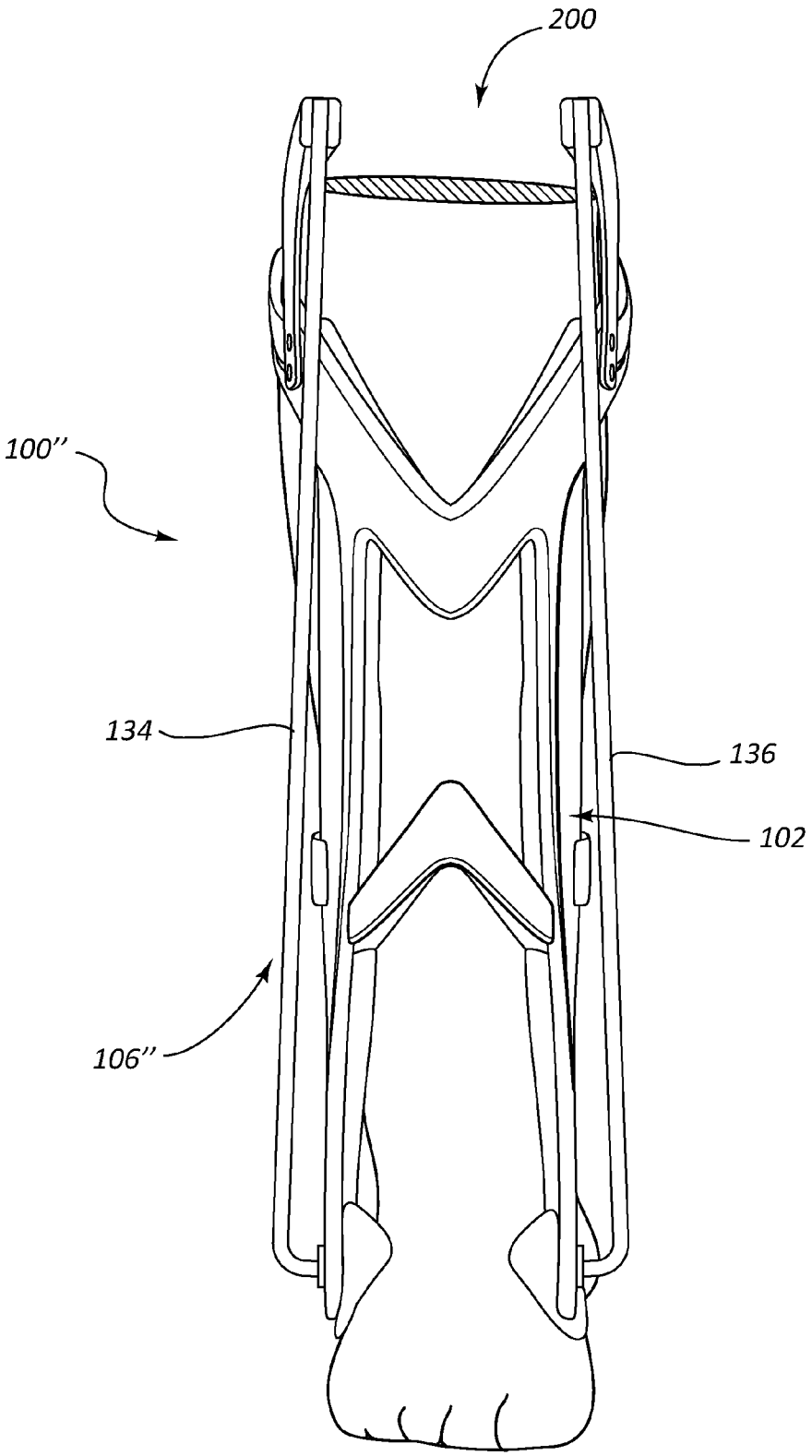
FIG. 7 is a front view of a portion of a second alternative swim fin strapped to the leg of a swimmer.

With reference now to FIG. 7, aspects of a second alternative swim fin 100" are disclosed. The second alternative swim fin 100" is identical to the first example swim fin 100 disclosed in FIGS. 1-5, except that the second alternative swim fin 100" includes a second alternative sliding assembly 106" in which the rails 134 and 136 gradually taper toward each other traveling upward from the bottom of the upper support frame 102 to the top of the upper support frame 102. This tapering of the non-parallel rails 134 and 136 requires a lower support frame having flexible cross members and a flexible means for aquatic propulsion (not shown) to enable the braces of the lower support frame (not shown) to collapse toward each other as the lower support frame travels upward along the non-parallel rails 134 and 136.

The second alternative sliding assembly 106" of the second alternative swim fin 100" can function to decrease the width of a corresponding lower support frame (not shown) when the lower support frame is slid into the walking position, thus reducing the possibility of the two lower support frames from contacting one another when the swimmer 200 is walking wearing a pair of the second alternative swim fins 100".

First Alternative Lower Support Frame

Figure 8:
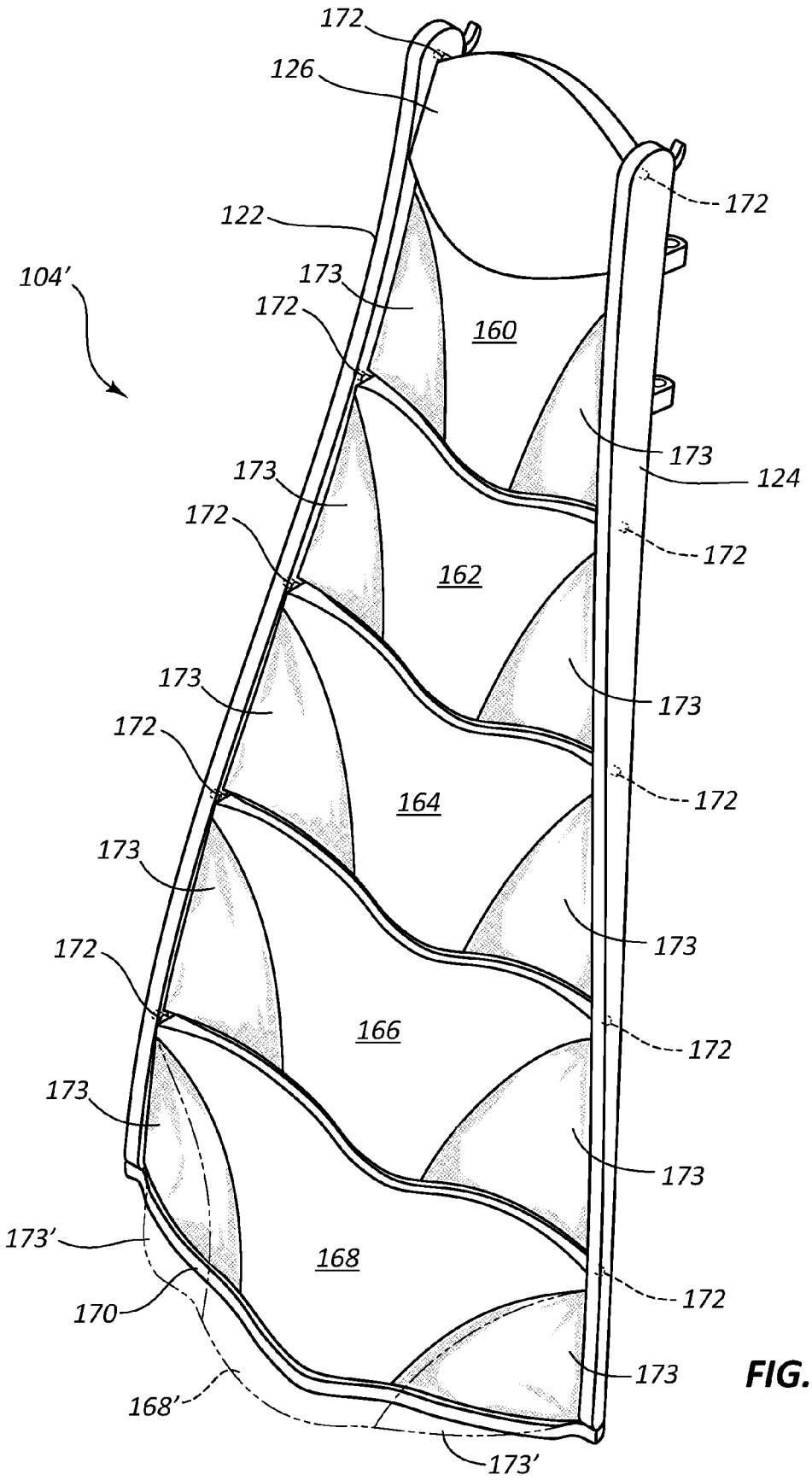
FIG. 8 is a perspective view of a first alternative lower support frame including a plurality of louvers.

With reference now to FIG. 8, aspects of a first alternative lower support frame 104' are disclosed. The first alternative lower support frame 104' is identical to the lower support frame 104 disclosed in FIGS. 1-5, except that the first alternative lower support frame 104' is missing the cross member 128, the blade 130 is replaced with louvers 160-168, and the blade protector 130 is replaced with a louver protector 170. Each of the louvers 160-168 may optionally include a pair of pins 172 connecting each louver to the braces 122 and 124. Further, each of the louvers 160-168 is connected to the braces 122 and 124 with a wedge-shaped elastic webbing 173 on each side of each louver.

During swimming, each of the louvers 160-168 automatically rotates downward during an upstroke (as shown for the louver 168 in phantom lines 168') and automatically rotating upward during a downstroke in order to direct water propulsion and provide increased forward thrust during both the up and downstrokes while swimming. The elastic webbings 173 tend to constrain the upward and downward rotations of the louvers 160-166 within a functional arc (as shown for the stretched elastic webbings 173 in phantom lines 173').

Second Alternative Lower Support Frame

Figure 9:
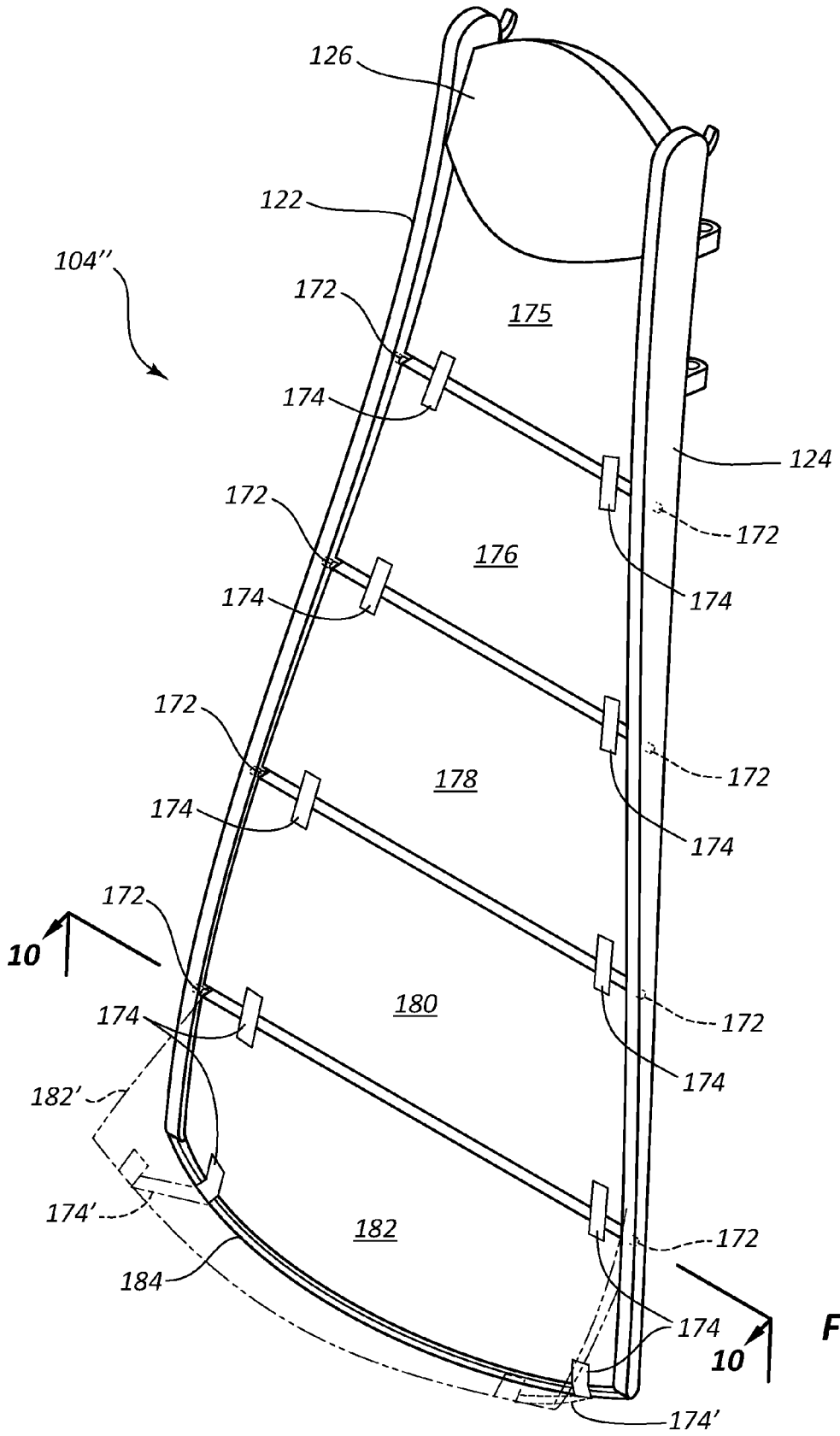
FIG. 9 is a perspective view of a second alternative lower support frame including a plurality of louvers.

With reference now to FIG. 9, aspects of a second alternative lower support frame 104" are disclosed. The second alternative lower support frame 104" is identical to the first alternative lower support frame 104' disclosed in FIG. 8, except that the louvers 160-168 are replaced with louvers 175-182, the louver protector 170 is replaced by a louver protector 184, and the elastic webbings 173 are replaced with elastic tabs 174.

During swimming, each of the louvers 175-182 functions similarly to the lovers 160-168 disclosed in FIG. 8, with each of the louvers 175-182 automatically rotating downward during an upstroke (as shown for the louver 182 in phantom lines 182') and automatically rotating upward during a downstroke in order to direct water propulsion and provide increased forward thrust during both the up and downstrokes while swimming. The elastic tabs 174 allow the automatic downward and upward rotation of the louvers 175-182, but do tend to constrain the downward and upward rotations of the louvers 175-182 within a functional arc (as shown for the stretched elastic tabs 174 in phantom lines 174').

It is understood that the elastic tabs 174 can be positioned near the edges of the louvers 175-182, as disclosed in FIG. 9, or the elastic tabs 174 can alternatively be positioned more toward the middle of the louvers 175-182. It is further understood that the elastic tabs 174 can attach each of the louvers 175-182 to the braces 122 and 124 instead of to the surrounding louvers. For example, the louver 182 can include two tabs (not shown) that attach the louver 182 to the braces 122 and 124.

Figure 10:
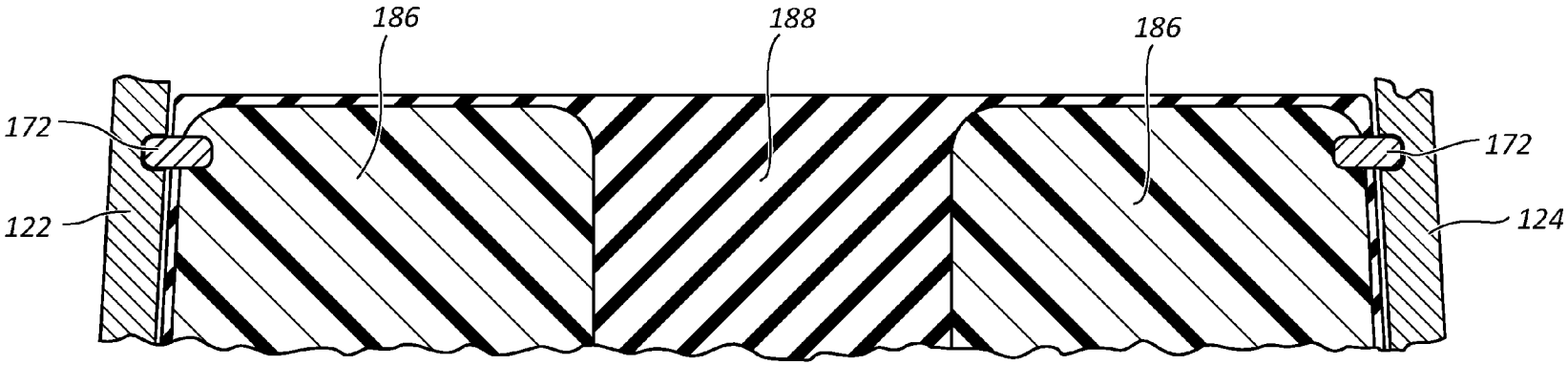
FIG. 10 is a cross-sectional view of a portion of the second alternative lower support frame including one of the louvers of FIG. 9.

Further, as disclosed in FIGS. 9 and 10, each of the louvers 175-182 includes a pair of relatively rigid plates 186 that is overmolded with a relatively flexible overmolding 188. For example, the plates 186 may be formed of metal or plastic and the overmolding 188 may be formed from rubber. The cross member 126 may also be similarly configured so that both the cross member 126 and the louvers 175-182 are able to flex down the middle to enable the braces 122 and 124 of the second alternative lower support frame 104" to collapse toward each. This semi-collapsible configuration of the second alternative lower support frame 104" enables the second alternative lower support frame 104" to be employed in the second alternative swim fin 100" with the non-parallel rails 134 and 136 disclosed in FIG. 7.

It is noted that the semi-collapsible configuration of the second alternative lower support frame 104" can alternatively be accomplished with relatively rigid plates that are fastened to, instead of being overmolded to, a relatively flexible middle section (not shown).

Third Alternative Lower Support Frame

Figure 11:
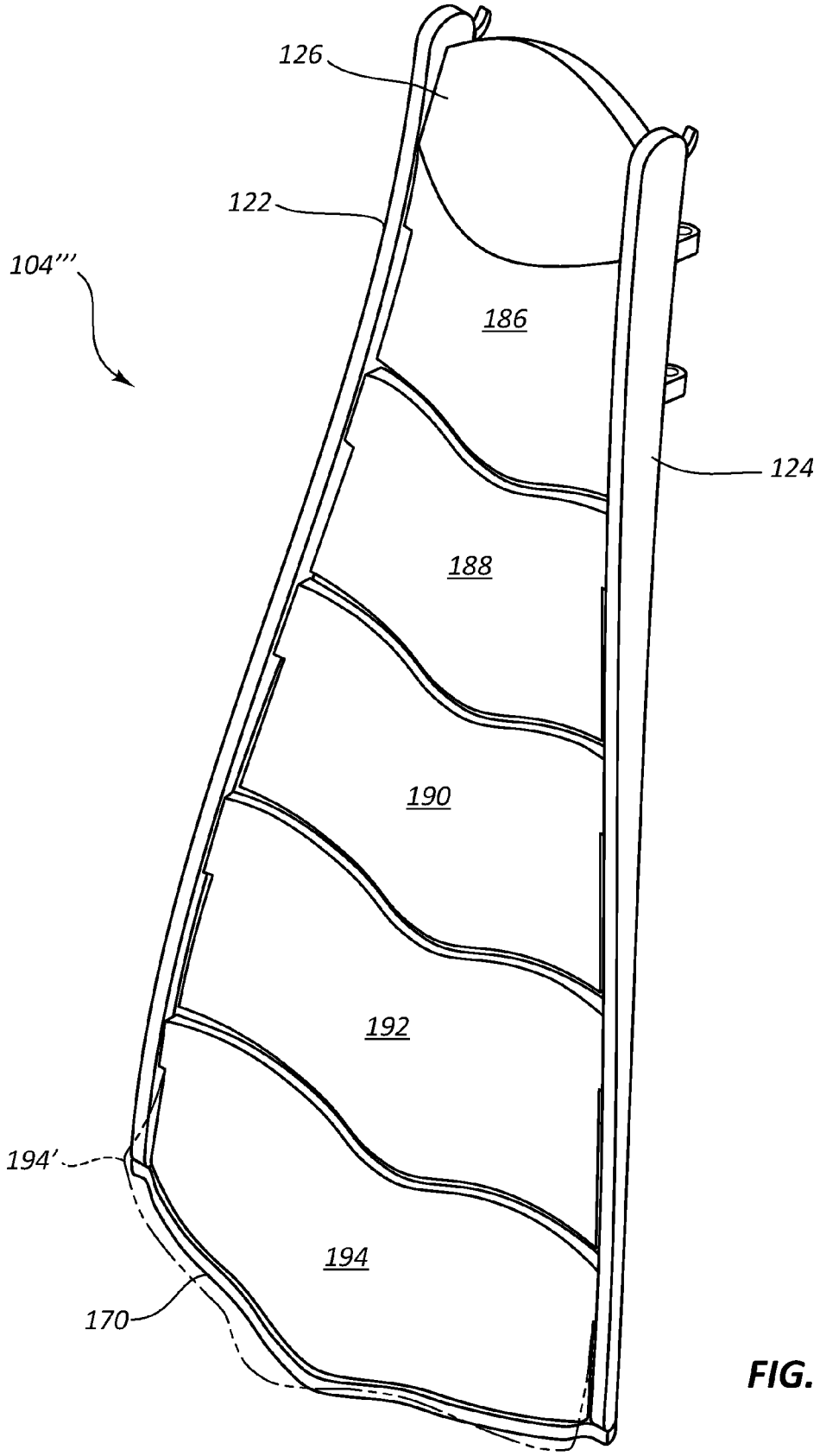
FIG. 11 is a perspective view of a third alternative lower support frame including a plurality of louvers.

With reference now to FIG. 11, aspects of a third alternative lower support frame 104''' are disclosed. The third alternative lower support frame 104''' is identical to the first alternative lower support frame 104' disclosed in FIG. 8, except that the louvers 160-168 are replaced with louvers 186-194 which do not include the pins 172 nor the elastic tabs 174. Instead, each of the louvers 186-194 is formed from a semi-rigid material, such as rubber or a rubber-like material, and each is attached to the braces 122 and 124 along about one-third of the width of the louver. This relatively flexible construction and relatively sturdy attachment of each of the louvers 186-194 enables the louvers to function similarly to the louvers 160-168 without the functionality of the pins 172 or the elastic tabs 174, with each of the louvers 186-194 automatically rotating downward during an upstroke (as shown for the louver 194 in phantom lines 194') and automatically rotating upward during a downstroke in order to direct water propulsion and provide increased forward thrust during both the up and downstrokes while swimming.

Other Alternative Embodiments

It is understood that the numbers, sizes, positions, and shapes of the hydrofoil chutes 133 and 158 disclosed in FIGS. 1 and 6, respectively, are example numbers, sizes, positions, and shapes only. Other numbers, sizes, positions, and shapes of hydrofoil chutes are possible and contemplated. For example, each of the blades 130 and 156 can have zero or more hydrofoil chutes. Further, the size of the hydrofoil chutes on the blades 130 and 156 can be smaller or larger than the chutes 133 and 158 disclosed in FIGS. 1 and 6, respectively. Also, the positions of the hydrofoil chutes can vary from the positions disclosed in FIGS. 1 and 6. Finally, the shapes of the openings of the hydrofoil chutes can differ from the generally parabolic shape disclosed in FIGS. 1 and 6. For example, the shapes of the hydrofoil chutes can be triagonal, trapezoidal, square, or pentagonal, for example. The openings of the hydrofoil chutes can also have any of a variety of different shapes.

It is further understood that although the braces 122 and 124 are disclosed throughout the Figures as having a generally flat configuration, it is understood that the distal ends of the braces 122 and 124 can instead be bent forward or backward in order to change the configuration of the walking position and/or swimming position of the braces 122 and 124. It is understood the bending the braces 122 and 124 either forward or backward can affect the rotation of the swimmer's ankle 208 during swimming.

It is also understood that other aspects of the swim fins disclosed herein can be modified and/or combined. For example, the bias of the elastic bands 148 can be reversed in order to automatically slide the various lower support frames disclosed herein from the swimming position to the walking position. In this example, a means for locking can be employed to allow the lower support frame to lock in the swimming position. The lower support frame can also be configured to lock in one of multiple swimming positions and/or one of multiple walking positions.

It is also understood that although a pair of rails are disclosed in connection with each of the sliding assemblies 106, 106', and 106", the functionality of the pair of rails could instead be combined into a single rail, or could be distributed across three or more rails. Further, the rails disclosed herein could be curved instead of straight. For example, the rails could be curved toward the top or bottom to encourage the lower support frame to remain in the walking position or swimming position, respectively. The curved rails can also fine tune the position of the lower support frame, such as the functional orientation of the lower support frame once extended into the swimming position or the functional orientation of the lower support frame once retracted into the walking position to reduce the possibility of one lower support frame from striking the other. In the walking position, the inside rail could also extend outward further than the outside rail to cause the lower support frame to rotate outward, thus reducing the possibility of the lower support frames from striking one another during walking. It is further understood that the functionality of the pair of elastic bands 148 can be combined into a single elastic band or similar means for biasing such as a corrosion-protected spring.

It is further understood that any of the lower support frames disclosed herein can additionally have a hinge or secondary slider to allow for a further extension of the associated means for aquatic propulsion.

It is also understood that any of the louvers disclosed in FIGS. 9-11 may be loosely attached to the braces 122 and 124 using a wedge-shaped elastic webbing on each side of each louver, similar to the elastic webbings 173 of FIG. 8. The elastic webbing can tend to constrain the degree of the upward and downward rotations of each of the louvers. This functionality can be augment, or replace, the functionality of the elastic tabs 174 disclosed in FIG. 9 or the functionality of the about one-third width attached portions of the louvers disclosed in FIG. 11.

CONCLUSION

The example swim fins disclosed herein thus allow the lower support frame to be quickly and easily placed in the swimming position to allow a swimmer to swim and in the walking position to allow the swimmer to walk. By attaching only to the lower leg of the swimmer, instead of to the foot and heel, the swim fins disclosed herein cause less ankle strain and calf muscle fatigue than typical swim fins. Further, attaching to the leg instead of to the foot and heel of the swimmer allows the swim fins disclosed herein to avoid the problems associated with rotational movement of the ankle joint and to consistently propel the swimmer in a direction that is aligned with the direction of the swimmer's legs and torso. In addition, once slid into the walking position, the swim fins disclosed herein can remain attached to the swimmer's leg without increasing the footprint of the swimmer, thus making the swim fins ideal for walking when entering or exiting water via a shoreline, a boat, or a dock. The swim fins disclosed herein also have relatively efficient hydrofoil properties. These advantages of the swim fins disclosed herein are accomplished without the integral foot pocket included in typical swim fins, and thus the problems associated with foot pockets listed herein are completely avoided. Further, unlike users of typical swim fins, a swimmer can wear the swim fins disclosed herein in the walking position and simultaneously experience the joyful and uninhibited sensation of walking bare-footed across the warm sand of a sandy beach or the cool grass of a grassy lawn. A swimmer can also wear the swim fins disclosed herein while simultaneously wearing various other types of footwear, such as sandals or water socks.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A retractable swim fin comprising:

an upper support frame configured to be generally positioned along and attached to the front of a swimmer's lower leg between the swimmer's knee and ankle;

a lower support frame including means for aquatic propulsion and configured to extend, in a swimming position, to a position covering the majority of the dorsum of the swimmer's foot, the lower support frame also configured to retract, in a walking position, to a position that does not interfere with the dorsum of the swimmer's foot, the walking position enabling the swimmer to walk barefoot on a surface without the lower support frame substantially contacting the surface; and a sliding assembly connecting the upper support frame to the lower support frame and configured to allow the lower support frame to retract by sliding upward from the swimming position to the walking position.

2. The retractable swim fin as recited in claim 1, further comprising padding positioned between the upper support frame and the swimmer's lower leg and/or foot and configured to make direct contact with the swimmer's lower leg and/or foot.

3. The retractable swim fin as recited in claim 1, wherein the upper support frame comprises:

two braces configured to be positioned on either side of the swimmer's lower leg and attached to the sliding assembly; and two cross members connecting the two braces.

4. The retractable swim fin as recited in claim 1, wherein the lower support frame further comprises:

two braces configured to be positioned on either side of the swimmer's foot and attached to the sliding assembly; and a cross member connecting the two braces, the cross member configured to provide support to the means for aquatic propulsion.

5. The retractable swim fin as recited in claim 1, further comprising means for locking the lower support frame in the walking position.

6. The retractable swim fin as recited in claim 1, wherein the sliding assembly comprises:

two rails attached to the upper support frame; and two slider clamps attached to the lower support frame, each slider clamp at least partially surrounding one of the rails, the slider clamps configured to allow the lower support frame to retract by sliding upward along the rails from the swimming position to the walking position and to extend by sliding downward along the rails from the walking position to the swimming position.

7. The retractable swim fin as recited in claim 6, further comprising an elastic band attached to the lower support frame and configured to automatically slide the lower support frame from the walking position to the swimming position.

8. The retractable swim fin as recited in claim 6, further comprising second means for aquatic propulsion positioned between the two rails.

9. The retractable swim fin as recited in claim 6, wherein the two rails are not parallel to each other.

10. The retractable swim fin as recited in claim 6, wherein the two rails are curved.

11. A retractable swim fin comprising:

an upper support frame configured to be generally positioned along and attached to the front of a swimmer's lower leg between the swimmer's knee and ankle;

a lower support frame including a lower blade and configured to extend, in a swimming position, to a position beneath the sole of the swimmer's foot, the lower support frame also configured to retract, in a walking position, to a position above the sole of the swimmer's foot, the walking position enabling the swimmer to walk barefoot on a surface without the lower support frame substantially contacting the surface; and a sliding assembly connecting the upper support frame to the lower support frame and configured to allow the lower support frame to retract by sliding upward from the swimming position to the walking position.

12. The retractable swim fin as recited in claim 11, wherein the sliding assembly comprises:

two rails attached to the upper support frame; and two slider clamps attached to the lower support frame, each slider clamp at least partially surrounding one of the rails, the slider clamps configured to allow the lower support frame to retract by sliding upward along the rails from the swimming position to the walking position and to extend by sliding downward along the rails from the walking position to the swimming position.

13. The retractable swim fin as recited in claim 12, wherein the sliding assembly further comprises:

means for locking the lower support frame in the walking position; and two elastic bands attached to the lower support frame and configured to automatically slide the lower support frame from the walking position to the swimming position.

14. The retractable swim fin as recited in claim 12, further comprising an upper blade positioned between the two rails.

15. A retractable swim fin comprising:

an upper support frame configured to be generally positioned along and attached to the front of a swimmer's lower leg between the swimmer's knee and ankle;

a lower support frame including one or more louvers and configured to extend, in a swimming position, to a position beneath the sole of the swimmer's foot, the lower support frame also configured to retract, in a walking position, to a position above the sole of the swimmer's foot, the walking position enabling the swimmer to walk barefoot on a surface without the lower support frame substantially contacting the surface; and a sliding assembly connecting the upper support frame to the lower support frame and configured to allow the lower support frame to retract by sliding upward from the swimming position to the walking position.

16. The retractable swim fin as recited in claim 15, wherein the sliding assembly comprises:

a rail attached to the upper support frame; and a slider clamp attached to the lower support frame, the slider clamp at least partially surrounding the rail, the slider clamp configured to allow the lower support frame to retract by sliding upward along the rail from the swimming position to the walking position and to extend by sliding downward along the rail from the walking position to the swimming position.

17. The retractable swim fin as recited in claim 16, wherein the sliding assembly further comprises:

means for locking the lower support frame in the walking position; and an elastic band attached to the lower support frame and configured to automatically slide the lower support frame from the walking position to the swimming position.

18. The retractable swim fin as recited in claim 15, wherein:

the lower support frame further comprises two braces configured to be positioned on either side of the swimmer's foot and attached to the sliding assembly and a cross member connecting the two braces and configured to provide support to the means for aquatic propulsion, and each louver is attached to both braces and configured to automatically rotate within a functionally constrained arc during each upstroke and downstroke of the swimmer's leg.

19. The retractable swim fin as recited in claim 15, wherein each louver comprises a rubber material or a plastic material and is attached to both braces along about one-third of the width of the louver.

20. The retractable swim fin as recited in claim 15, wherein one or more of the louvers is attached to the two braces using a wedge-shaped elastic webbing on each side of the one or more louvers.

21. A swim fin comprising:

an upper support frame configured to be generally positioned along and attached to the front of a swimmer's lower leg between the swimmer's knee and ankle, the upper support frame comprising a top portion that extends out from the swimmer's lower leg and a lower portion that extends out from the swimmer's lower leg and is configured to be positioned on top of the swimmer's foot;

two rails that are each attached to the upper support frame on opposite sides of the upper support frame, each rail extending between the top portion and the bottom portion of the upper support frame such that the rails are positioned in front of the swimmer's lower leg and extend along a plane that runs generally parallel to the swimmer's lower leg; and means for aquatic propulsion connected between the two rails such that the means for aquatic propulsion are positioned in front of the swimmer's lower leg and extend along the plane that runs generally parallel to the swimmer's lower leg thereby increasing the propulsion caused when the swimmer's lower leg travels through water in a direction generally perpendicular to the plane.

22. The swim fin as recited in claim 21, wherein the means for aquatic propulsion comprises a blade attached between the two rails having one or more hydrofoil chutes.

23. The swim fin as recited in claim 22, wherein each hydrofoil chute allows water to be pushed through the blade in a direction that is generally inline with the forward motion of the swimmer, each hydrofoil chute sized and configured to not contact the upper support frame during the forward motion of the swimmer.

24. The swim fin as recited in claim 21, wherein the means for aquatic propulsion comprises one or more louvers attached between the two rails.

25. The swim fin as recited in claim 24, wherein each louver is configured to automatically rotate within a functionally constrained arc during each upstroke and downstroke of the swimmer's leg such that the louver does not contact the upper support frame.

* * * * *